US010997916B2

(12) United States Patent
Zhang et al.

(10) Patent No.: US 10,997,916 B2
(45) Date of Patent: May 4, 2021

(54) DRIVING METHOD WITH COMPENSATION FOR PIXEL DRIVING CIRCUIT, DISPLAY PANEL, AND DISPLAY DEVICE

(71) Applicant: Xiamen Tianma Micro-Electronics Co., Ltd., Xiamen (CN)

(72) Inventors: Yuheng Zhang, Xiamen (CN); Yong Yuan, Shanghai (CN); Jieliang Li, Xiamen (CN); Wanming Huang, Xiamen (CN); Yingteng Zhai, Shanghai (CN)

(73) Assignee: XIAMEN TIANMA MICRO-ELECTRONICS CO., LTD., Xiamen (CN)

( * ) Notice: Subject to any disclaimer, the term of this patent is extended or adjusted under 35 U.S.C. 154(b) by 0 days.

(21) Appl. No.: 16/718,834

(22) Filed: Dec. 18, 2019

(65) Prior Publication Data

US 2020/0279524 A1 Sep. 3, 2020

(30) Foreign Application Priority Data

Feb. 28, 2019 (CN) ..... 201910152436.5

(51) Int. Cl.
*G09G 3/3233* (2016.01)
*G09G 3/32* (2016.01)

(52) U.S. Cl.
CPC ..... *G09G 3/3233* (2013.01); *G09G 3/32* (2013.01); *G09G 2300/0426* (2013.01); *G09G 2300/0842* (2013.01); *G09G 2310/0202* (2013.01); *G09G 2320/0233* (2013.01)

(58) Field of Classification Search
CPC ..... G09G 3/3233–3258; G09G 3/32; G09G 3/3208; G09G 2320/0233; G09G 2310/0202; G09G 2300/0842; G09G 2300/0819
See application file for complete search history.

(56) References Cited

U.S. PATENT DOCUMENTS 8,159,423 B2 * 4/2012 Choi ..... G09G 3/3233 345/76
2019/0180690 A1 * 6/2019 Kim ..... G09G 3/3266
2020/0221554 A1 * 7/2020 Chiang ..... G09G 1/00

FOREIGN PATENT DOCUMENTS

CN 103400552 A 11/2013

* cited by examiner

*Primary Examiner* — Xuemei Zheng
(74) *Attorney, Agent, or Firm* — Anova Law Group PLLC

(57) ABSTRACT

Driving method for driving circuit, display panel, and display device are provided. The method includes: in a data writing stage, transmitting data signal voltage to a gate electrode of the driving transistor in response to a scan signal in a first scan signal line; in a light-emitting stage, turning on a driving path connecting the driving transistor to the light-emitting device, and making the driving transistor generate a driving current based on the voltage of the gate electrode in the driving transistor to drive the light-emitting device to emit light, in response to a light-emitting signal in a light-emitting signal line; and in a compensation stage, compensating the voltage of the gate electrode in the driving transistor by using a first power signal voltage. The light-emitting stage and the compensation stage overlap with each other, and a starting time of the compensation stage is after a starting time of the light-emitting stage.

15 Claims, 8 Drawing Sheets

DRIVING METHOD WITH COMPENSATION FOR PIXEL DRIVING CIRCUIT, DISPLAY PANEL, AND DISPLAY DEVICE

CROSS-REFERENCES TO RELATED APPLICATION

This application claims the priority of Chinese Patent Application No. 201910152436.5, filed on Feb. 28, 2019, the content of which is incorporated herein by reference in its entirety.

TECHNICAL FIELD

The present disclosure generally relates to the field of display technology and, more particularly, relates to a driving method for a pixel driving circuit, a display panel, and a display device.

BACKGROUND

With a gradual rise of wearable devices including smart eyeglasses and smartwatches, flexible display devices are increasingly demanded in the display industry. Organic light-emitting diode (OLED) display devices have advantages of self-illumination without backlight powers, low driving voltage, high luminous efficiency, fast response, light weight, small thickness, and high contrast, and are regarded as next generation of display devices with the most potential.

Pixels in an organic light-emitting display device include pixel driving circuits for controlling light-emitting devices in the pixels effectively. Transistors in the pixel driving circuits produce driving currents and the light-emitting devices respond to the driving currents to emit light. However, the display devices using the pixel driving circuits face many problems including transistor variations, IR drops, and aging of the light-emitting devices. These problems affect the driving currents and the transistors in each pixel driving circuit are inconsistent between different pixels. A display failure may occur in the display panel. For example, an inhomogeneous display may occur, and the image quality of the display panel may be reduced.

There is a need to provide a driving method for a pixel driving circuit, a display panel, and a display device with improved display quality, to alleviate the inhomogeneous display.

SUMMARY

One aspect of the present disclosure provides a driving method for a pixel driving circuit including a driving transistor and a light-emitting device. The method includes: in a data writing stage, transmitting a data signal voltage to a gate electrode of the driving transistor in response to a scan signal in a first scan signal line; in a light-emitting stage, turning on a driving path between the driving transistor and the light-emitting device, and making the driving transistor generate a driving current based on the voltage of the gate electrode in the driving transistor to drive the light-emitting device to emit light, in response to a light-emitting signal in a light-emitting signal line; and in a compensation stage, compensating the voltage of the gate electrode in the driving transistor by using a first power signal voltage. The light-emitting stage and the compensation stage overlap with each other, and a starting time of the compensation stage is after a starting time of the light-emitting stage.

Another aspect of the present disclosure provides a display panel. The display panel includes a display region and a non-display region. The display region includes a plurality of pixel units arranged in an array, a plurality of light-emitting signal lines, a plurality of scan signal lines. The plurality of pixel units includes pixel driving circuits driven by a driving method. Each of the pixel driving circuits includes a driving transistor and a light-emitting device. The driving method includes: in a data writing stage, transmitting a data signal voltage to a gate electrode of the driving transistor in response to a scan signal in a first scan signal line; in a light-emitting stage, turning on a driving path between the driving transistor and the light-emitting device, and making the driving transistor generate a driving current based on the voltage of the gate electrode in the driving transistor to drive the light-emitting device to emit light, in response to a light-emitting signal in a light-emitting signal line; and in a compensation stage, compensating the voltage of the gate electrode in the driving transistor by using a first power signal voltage. The light-emitting stage and the compensation stage overlap with each other, and a starting time of the compensation stage is after a starting time of the light-emitting stage. The plurality of scan signal lines at least includes a plurality of first scan signal lines and a plurality of second scan signal lines. The pixel driving circuits corresponding to pixel units of the plurality of pixel units disposed in a same row are electrically connected to one of the plurality of first scan signal lines and corresponding one of the plurality of second scan signal lines. The non-display region includes a first scan signal control circuit electrically connected to the plurality of first scan signal lines, a second scan signal control circuit electrically connected to the plurality of second scan signal lines, and a light-emitting control circuit electrically connected to the plurality of light-emitting signal lines.

Another aspect of the present disclosure provides a display device. The display device includes a display panel. The display panel includes a display region and a non-display region. The display region includes a plurality of pixel units arranged in an array, a plurality of light-emitting signal lines, a plurality of scan signal lines. The plurality of pixel units includes pixel driving circuits driven by a driving method. Each of the pixel driving circuits includes a driving transistor and a light-emitting device. The driving method includes: in a data writing stage, transmitting a data signal voltage to a gate electrode of the driving transistor in response to a scan signal in a first scan signal line; in a light-emitting stage, turning on a driving path between the driving transistor and the light-emitting device, and making the driving transistor generate a driving current based on the voltage of the gate electrode in the driving transistor to drive the light-emitting device to emit light, in response to a light-emitting signal in a light-emitting signal line; and in a compensation stage, compensating the voltage of the gate electrode in the driving transistor by using a first power signal voltage. The light-emitting stage and the compensation stage overlap with each other, and a starting time of the compensation stage is after a starting time of the light-emitting stage. The plurality of scan signal lines at least includes a plurality of first scan signal lines and a plurality of second scan signal lines. The pixel driving circuits corresponding to pixel units of the plurality of pixel units disposed in a same row are electrically connected to one of the plurality of first scan signal lines and corresponding one of the plurality of second scan signal lines. The non-display region includes a first scan signal control circuit electrically connected to the plurality of first scan signal lines, a second scan signal control circuit electrically connected to the plurality of second scan signal lines, and a light-emitting control circuit electrically connected to the plurality of light-emitting signal lines.

Other aspects or embodiments of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Figure 1:
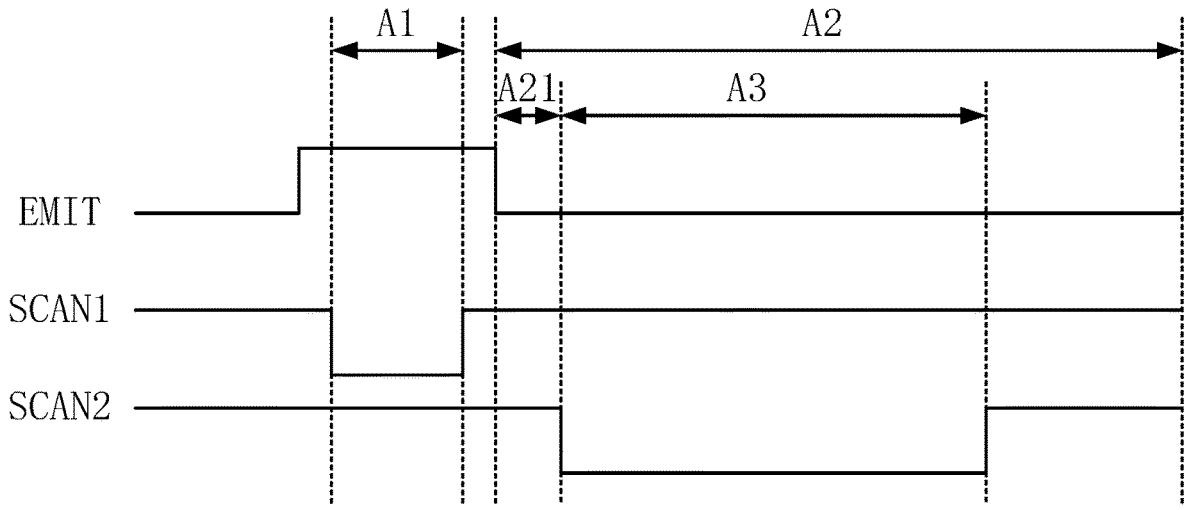
FIG. 1 illustrates a driving timing chart corresponding to an exemplary driving method for a pixel driving circuit consistent with various disclosed embodiments in the present disclosure.

Reference will now be made in detail to exemplary embodiments of the disclosure, which are illustrated in the accompanying drawings. Hereinafter, embodiments consistent with the disclosure will be described with reference to drawings. In the drawings, the shape and size may be exaggerated, distorted, or simplified for clarity. Wherever possible, the same reference numbers will be used throughout the drawings to refer to the same or like parts, and a detailed description thereof may be omitted.

Further, in the present disclosure, the disclosed embodiments and the features of the disclosed embodiments may be combined under conditions without conflicts. It is apparent that the described embodiments are some but not all of the embodiments of the present disclosure. Based on the disclosed embodiments, persons of ordinary skill in the art may derive other embodiments consistent with the present disclosure, all of which are within the scope of the present disclosure.

Moreover, the present disclosure is described with reference to schematic diagrams. For the convenience of descriptions of the embodiments, the cross-sectional views illustrating the device structures may not follow the common proportion and may be partially exaggerated. Besides, those schematic diagrams are merely examples, and not intended to limit the scope of the disclosure. Furthermore, a three-dimension. (3D) size including length, width and depth should be considered during practical fabrication.

The present disclosure provides a driving method for a pixel driving circuit, a display panel, and a display device. The pixel driving circuit may include a driving transistor and a light-emitting device. The driving method for the pixel driving circuit may include a data writing stage, a light-emitting stage, and a compensation stage. The light-emitting stage and the compensation stage overlap with each other, and a starting time of the compensation stage is after a starting time of the light-emitting stage. The display panel may include a display region and a non-display region. The display region may include a plurality of pixel units arranged in an array, a plurality of light-emitting signal lines, a plurality of scan signal lines. The plurality of pixel units may include pixel driving circuits driven by the driving method. The display device may include the display panel. In the present disclosure, an influence of a current in a present pixel of the plurality of pixel units may be considered in the compensation in a real-time, to achieve a better compensation. Different pixel units of the plurality of pixel units may display more uniformly, and the display performance and the display quality may be improved.

Figure 2:
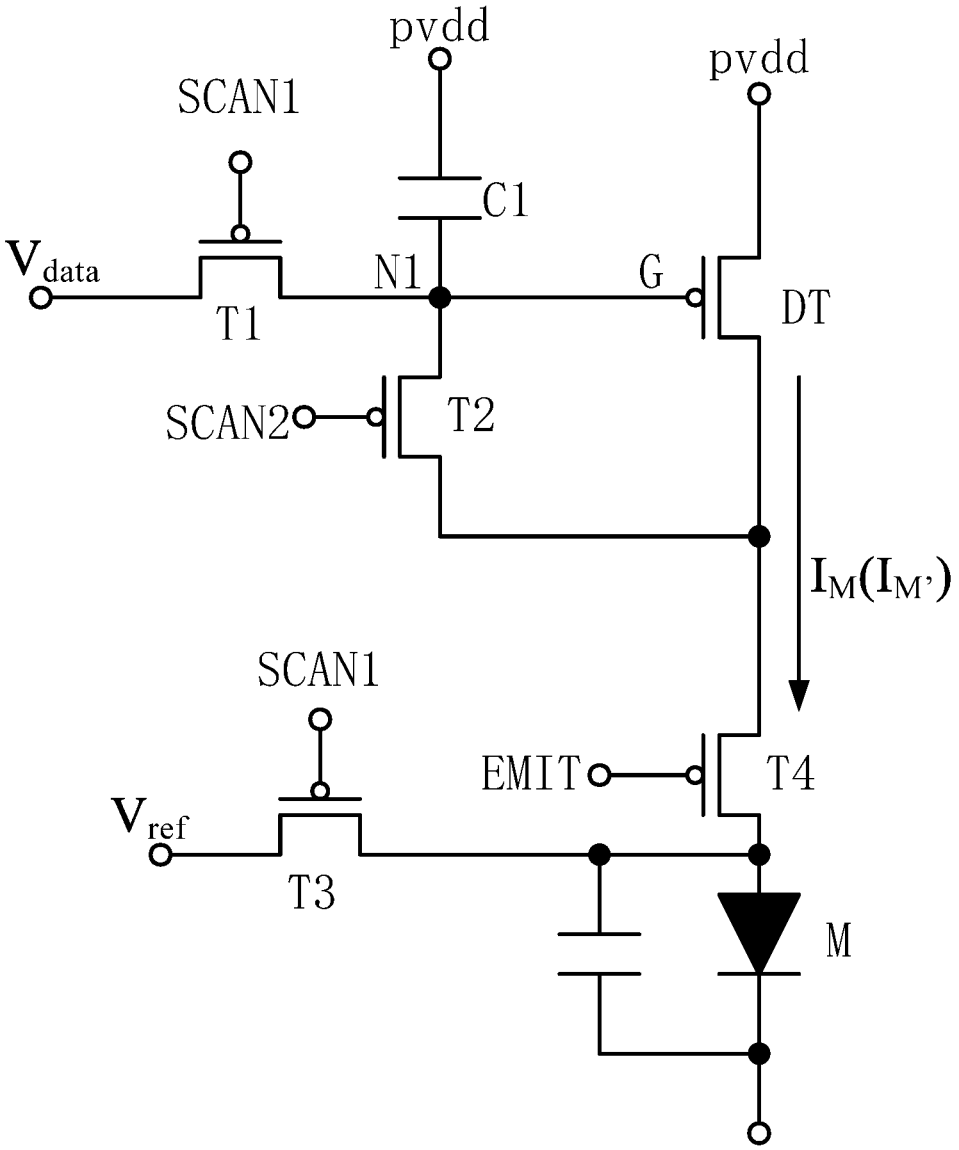
FIG. 2 illustrates an exemplary pixel driving circuit consistent with various disclosed embodiments in the present disclosure.

FIG. 1 illustrates a driving timing chart corresponding to an exemplary driving method for a pixel driving circuit consistent with various disclosed embodiments in the present disclosure, and FIG. 2 illustrates an exemplary pixel driving circuit consistent with various disclosed embodiments in the present disclosure. As illustrated in FIGS. 1-2, in some embodiments, the pixel driving circuit may include a driving transistor DT and a light-emitting device M.

The driving method for the pixel driving circuit may include:

in a data writing stage A1, responding to scan signals in a first scan signal line SCAN1 and transmitting a data signal voltage $V_{data}$ to a gate electrode G of the driving transistor DT;

in a light-emitting stage A2, responding to light-emitting signals in a light-emitting signal line EMIT, turning on a driving wire between the driving transistor DT and the light-emitting device M, generating a driving current $I_M$ by the driving transistor DT according to the voltage of the gate electrode G in the driving transistor DT, and driving the light-emitting device M to emit light; and in a compensation stage A3, responding to the light-emitting signals in the light-emitting signal line EMIT and scan signals in a second scan signal line SCAN2, compensating the voltage of the gate electrode G of the driving transistor DT using a first power signal voltage pvdd.

The light-emitting stage A2 and the compensation stage A3 may overlap, and a starting time of the compensation stage A3 may be after a starting time of the light-emitting stage A2.

In the driving method for the pixel driving circuit provided by the present disclosure, the driving method may include at least the data writing stage A1, the light-emitting stage A2, and the compensation stage A3. In the data writing stage A1, responding to the scan signals in the first scan signal line SCAN1 (that is, the first scan signal line SCAN1 may transmit an enable signal to the pixel driving circuit, and other signal lines including the light-emitting signal line EMIT and the second scan signal line SCAN2 may transmit non-enable signals to the pixel driving circuit), and the data signal voltage $V_{data}$ may be transmitted to the gate electrode G of the driving transistor DT. In the light-emitting stage A2, responding to light-emitting signals in a light-emitting signal line EMIT (that is, the light-emitting signal line EMIT may transmit an enable signal to the pixel driving circuit, and other signal lines including the first scan signal line SCAN1 and the second scan signal line SCAN2 may transmit non-enable signals to the pixel driving circuit), the driving wire between the driving transistor DT and the light-emitting device M may be turn on, and the driving transistor DT may generate the driving current $I_M$ according to the voltage at the gate electrode G of the driving transistor DT to drive the light-emitting device M to emit light. After starting the light-emitting stage A2, the compensation stage A3 may start. Responding to the light-emitting signals in the light-emitting signal line EMIT and scan signals in a second scan signal line SCAN2 (that is, the light-emitting signal line EMIT and the second scan signal line SCAN2 may transmit an enable signal to the pixel driving circuit, and other signal lines including the first scan signal line SCAN1 may transmit non-enable signals to the pixel driving circuit), the voltage of the gate electrode G of the driving transistor DT may be compensated using the a first power signal voltage pvdd. Then responding to light-emitting signals in a light-emitting signal line EMIT (that is, the light-emitting signal line EMIT may transmit an enable signal to the pixel driving circuit, and other signal lines including the first scan signal line SCAN1 and the second scan signal line SCAN2 may transmit non-enable signals to the pixel driving circuit), the driving transistor DT may generate a new driving current $I_M'$ according to the voltage after compensation at the gate electrode G of the driving transistor DT to drive the light-emitting device M to emit light.

In current technologies, a driving current $I_{ds}$ of a driving transistor DT is given by $I_{ds}=K*(V_{gs}-V_{th})^2$ where K is a constant, $V_{gs}$ is a voltage difference between the gate electrode and a source of the driving transistor DT, and $V_{th}$ is a threshold voltage of the driving transistor DT. $V_{gs}$ is given by $V_{gs}=V_g-V_s$ where $V_g$ is a voltage of the gate electrode of the driving transistor DT and $V_s$ is a voltage of the source of the driving transistor DT. In the present embodiment, the threshold voltage $V_{th}$ of the driving transistor DT may be a negative value when the driving transistor DT is a P-type transistor. Correspondingly, the driving current I of the driving transistor DT may be given by $I=K*(V_{gs}+|V_{th}|)^2$, and both the gate electrode voltage and the source voltage of the driving transistor DT may affect a magnitude of the driving current. An end of the first power signal line may be connected to a display panel driving circuit and the first power signal voltage pvdd may be transmitted and provided to a plurality of pixel driving circuits corresponding to different pixels through the first power signal line. Since each of the plurality of pixel driving circuits connected to the first power signal line may have different distance to the display panel driving circuit and current flowing through the first power signal line corresponding to each of the plurality of pixel driving circuits (driving current corresponding to each of the plurality of pixel driving circuits) may be different, voltage drop on the first power signal line corresponding to different pixels in the display panel and the first power signal voltage pvdd received by different pixels may be different. Power voltage of a driving transistor DT in each of the plurality of pixel driving circuits may vary and driving current generated by the driving transistor DT in each of the plurality of pixel driving circuits may be different. A display uniformity of the display panel may be affected. Especially, when the light-emitting device in the pixel driving circuit is a sub-millimeter light-emitting diode (Mini LED), a driving current for the Mini LED may be much larger than an organic light-emitting diode, when the light-emitting device in the pixel driving circuit is a sub-millimeter light-emitting diode, a difference in the voltage drop may not be ignored and influence on the display uniformity of the display panel may be large.

In the present disclosure, the light-emitting stage A2 and the compensation stage A3 may overlap, and the starting time of the compensation stage A3 may be after the starting time of the light-emitting stage A2. Influence of the current of the present pixel may be considered in the compensation, and the compensation may be performed when emitting light. In the compensation stage A3, the voltage of the gate electrode G of the driving transistor DT may be compensated using the voltage pvdd of the first power signal. Since the starting time of the compensation stage A3 may be after the starting time of the light-emitting stage A2, influence of different driving current on the first power signal voltage pvdd may be compensated in real-time. A difference between the driving current in different pixel driving circuits corresponding to different pixels may be reduced, and a display of different pixels may be more uniform. A better display quality may be achieved, and display performance of the display panel may be improved.

For description purposes only, the embodiment with the time chart illustrated in FIG. 1 including possible working stages is used as an example to illustrate the present disclosure and should not limit scopes of the present disclosure. In various embodiments, the time chart corresponding to the pixel driving circuit may include any suitable working stages, as long as the light-emitting stage A2 and the compensation stage A3 overlap, and the starting time of the compensation stage A3 is after the starting time of the light-emitting stage A2. For example, in one embodiment, the time chart corresponding to the pixel driving circuit may further include an initialization stage and a reset stage, besides the working stages in FIG. 1.

In one embodiment, a duration time of the compensation stage (that is a compensation time) may be adjusted by adjusting a duration time of the enable signal transmitted to the pixel driving circuit through the second scan signal line SCAN2. When the duration time of the enable signal transmitted to the pixel driving circuit through the second scan signal line SCAN2 is longer, the compensation time may be longer, and the compensation of the first power signal voltage pvdd on the voltage of the gate electrode of the driving transistor DT may be larger.

Figure 3:
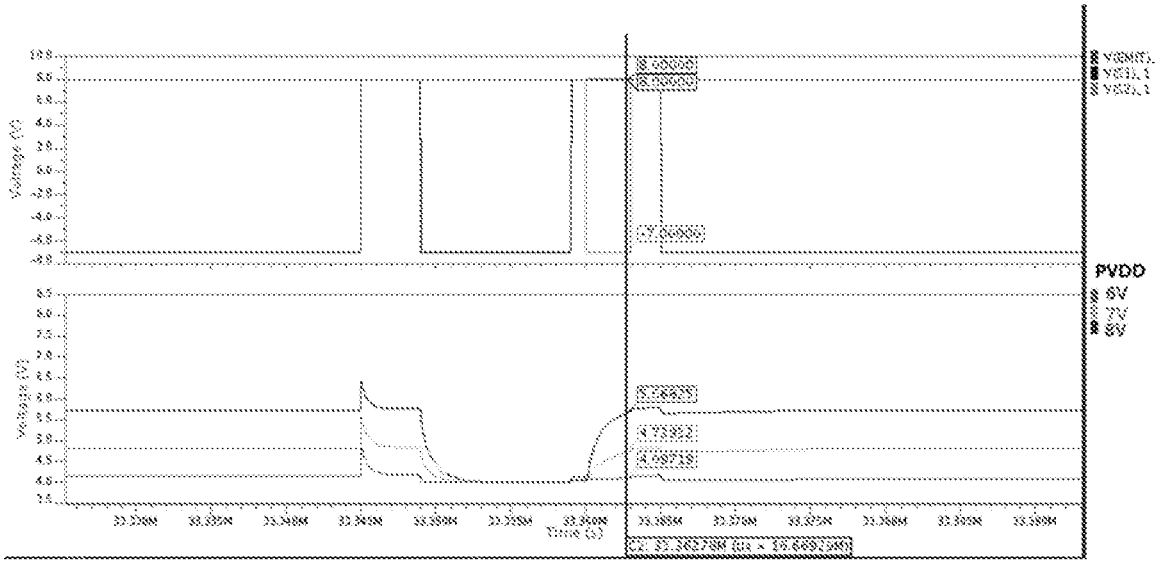
FIG. 3 illustrates an exemplary compensation result obtained by using different compensation time in an exemplary driving method for a pixel driving circuit consistent with various disclosed embodiments in the present disclosure.
Figure 4:
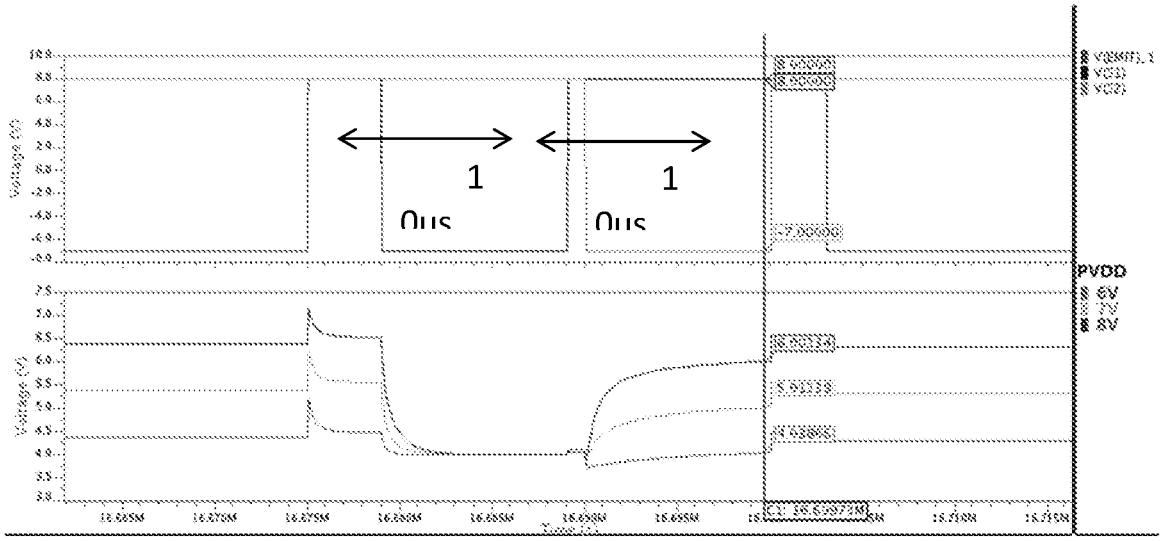
FIG. 4 illustrates another exemplary compensation result obtained by using different compensation time in an exemplary driving method for a pixel driving circuit consistent with various disclosed embodiments in the present disclosure.

The compensation time should not be too short or too long. FIG. 3 illustrates an exemplary compensation result obtained by using different compensation time in an exemplary driving method for a pixel driving circuit consistent with various disclosed embodiments in the present disclosure; and FIG. 4 illustrates another exemplary compensation result obtained by using different compensation time in an exemplary driving method for a pixel driving circuit consistent with various disclosed embodiments in the present disclosure. In FIG. 3, the compensation time is 3 μs and the data signal voltage $V_{data}$ is 4 V. Different first power signal voltage pvdd of 6 V, 7V, and 8V, is used to simulate a voltage drop of the first power signal voltage pvdd and the voltage of the gate electrode of the driving transistor DT is monitored. The simulation results are list in following Table 1.

TABLE 1

| | Pvdd | $V_g$ after compensation | $V_{gs}$ after compensation | $V_{gs}$ before compensation |
|---|---|---|---|---|
| $V_{data}$ = 4 V | 6 V | 4.10 V | 1.99 V | 2 V |
| | 7 V | 4.74 V | 2.26 V | 3 V |
| | 8 V | 5.67 V | 2.33 V | 4 V |

As illustrated in Table 1, when the first power signal voltage pvdd corresponding to the driving transistor DT is different, the compensation may reduce a different of the voltage drops between the gate electrode and the source of the driving transistor DT corresponding to different first power signal voltage pvdd, to reduce a difference of the driving current of the driving transistor DT corresponding to different first power signal voltage pvdd. For example, as illustrated in Table 1, when pvdd=6 V and pvdd=8 V, a difference between $V_{gs}$ with pvdd=6V and $V_{gs}$ with pvdd=8 V may be 2 V before the compensation, and the difference between $V_{gs}$ with pvdd=6V and $V_{gs}$ with pvdd=8 V may be reduced to 0.34 V after the compensation. The first power signal voltage pvdd may have a certain compensation on the voltage of the gate electrode of the driving transistor DT and the pixel driving circuit in the present disclosure may have a certain compensation result.

In FIG. 4, the compensation time is 10 μs and the data signal voltage $V_{data}$ is 4 V or 2 V. Different first power signal voltage pvdd of 6 V, 7V, and 8V, is used to simulate a voltage drop of the first power signal voltage pvdd and the voltage of the gate electrode of the driving transistor DT is monitored. The simulation results with the data signal voltage $V_{data}$ of 4 V are list in the following Table 2.

TABLE 2

| | Pvdd | $V_g$ after compensation | $V_{gs}$ after compensation |
|---|---|---|---|
| $V_{data}$ = 4 V | 6 V | 4.03 V | 1.97 V |
| | 7 V | 5.01 V | 1.99 V |
| | 8 V | 6 V | 2 V |

The simulation results with the data signal voltage $V_{data}$ of 2 V are list in the following Table 3.

TABLE 3

| | Pvdd | $V_g$ after compensation | $V_{gs}$ after compensation |
|---|---|---|---|
| $V_{data}$ = 2 V | 6 V | 3.99 V | 2.01 V |
| | 7 V | 4.99 V | 2.01 V |
| | 8 V | 5.97 V | 2.03 V |

As illustrated in Table 1 and Table 2, after compensation with a duration time of 10 μs, $V_{gs}$ is 2 V corresponding to the data signal voltage $V_{data}$ of 4 V and the data signal voltage $V_{data}$ of 2 V. Different data signal voltage $V_{data}$ cannot be distinguished. Correspondingly, the compensation with a compensation time of 10 μs may not achieve a compensation result and may be not feasible. The compensation should not be too long and may be configured according to actual needs.

In some embodiments, as illustrated in FIGS. 1-2, the pixel driving circuit may further include a first transistor T1, a second transistor T2, a third transistor T3, and a fourth transistor T4.

For the first transistor T1, a gate electrode of may be electrically connected to the first scan signal line SCAN1, a first electrode may be electrically connected to the data signal line, and a second electrode may be electrically connected to a first node N1. The data signal line may provide the data signal voltage $V_{data}$.

For the driving transistor DT, the gate electrode G may be electrically connected to the first node N1, a first electrode may be electrically connected to the first power signal line, and a second electrode may be electrically connected to a first electrode of the fourth transistor T4. The first power signal line may provide the first power signal voltage pvdd.

For the second transistor T2, a gate electrode may be electrically connected to the second scan signal line SCAN2, a first electrode may be electrically connected to the first node N1, and a second electrode may be electrically connected to the second electrode of the driving transistor DT.

For the third transistor T3, a gate electrode may be electrically connected to the first scan signal line SCAN1, a first electrode may be electrically connected to a reference voltage signal line, and a second electrode may be electrically connected to the second electrode of the fourth transistor T4. The reference voltage signal line may provide a reference signal voltage $V_{ref}$.

For the fourth transistor T4, a gate electrode may be electrically connected to the light-emitting signal line EMIT and the second electrode may be electrically connected to the light-emitting device M.

The pixel driving circuit corresponding to the driving method in the embodiment of the present disclosure may work in following processes:

in the data writing stage A1, the first transistor T1 and the third transistor T3 may be turned on, the second transistor T2 and the fourth transistor T4 may be turned off, correspondingly the data signal line may transmit the data signal voltage $V_{data}$ to the first node N1 and the gate electrode G of the driving transistor DT, and the reference voltage signal line may transmit the reference signal voltage $V_{ref}$ to the light-emitting device M;

in a starting stage (A21 in FIG. 1) of the light-emitting stage A2, the fourth transistor may be turn on, while the first transistor T1, the second transistor T2, and the third transistor T3 may be turn off, the driving path between the driving transistor DT and the light-emitting device M may be turned on, the driving transistor DT may generate the driving current IM according to the voltage of the gate electrode of the driving transistor DT to drive the light-emitting device M to emit light;

in the compensation stage A3, the first transistor T1 and the third transistor T3 may be turned off, the second transistor T2 and the fourth transistor T4 may be turned on, correspondingly, an input terminal of the first power signal voltage pvdd may be electrically connected to the first node N1, the first power signal voltage pvdd may charge or discharge a first capacitor C1 (whether the first capacitor is charged or discharged may be adjusted according to a comparison between the voltage of the first node N1 and the voltage of the second electrode of the driving transistor DT) to compensate the voltage of the gate electrode G of the driving transistor DT; and at last, the fourth transistor may be turn on, while the first transistor T1, the second transistor T2, and the third transistor T3 may be turned off, correspondingly, the driving transistor DT may generate the new driving current $I_M'$ according to the voltage after compensation of the gate electrode G of the driving transistor DT to drive the light-emitting device M to emit light.

In the embodiment of the present disclosure, the signals of the first scan signal line SCAN1, the second scan signal line SCAN2, the light-emitting signal line EMIT, the data signal line, the first power signal line, and the reference voltage signal line, may be provided by a driving chip in the display panel or by other external configuration. The present disclosure has no limit on this. For description purposes only, the embodiment with the above circuit structure for the pixel driving circuit corresponding to the driving method above are used as examples to illustrate the present disclosure and should not limit the scopes of the present disclosure. In various embodiments, the pixel driving circuit may have any suitable circuit structure and the present disclosure has no limit on this. For one of the transistors in the pixel driving circuit, the first electrode may be the source of the transistor and the second electrode may be the drain of the transistor, or the first electrode may be the drain of the transistor and the second electrode may be the source of the transistor. The present disclosure has no limit on this.

After starting the light-emitting stage A2, for the driving transistor DT, the voltage of the gate electrode G may be $V_{data}$, the voltage of the first electrode may be the first power signal voltage pvdd, and the voltage of the second electrode may be pvdd+$V_{th}$ where $V_{th}$ is the threshold voltage of the driving transistor DT. Correspondingly, a working current of the driving transistor DT may be Ids. After starting the compensation stage A3, the first power signal voltage pvdd may be transmitted to the gate electrode G of the driving transistor DT for compensation. A compensation charge may be $\Delta Q \approx I_{ds} \times \Delta t$ ($\Delta t$ is the compensation time, that is, the duration time of the enable signal transmitted to the pixel driving circuit through the second scan signal line SCAN2). Since the working current Ids may change according to the voltage of the gate electrode G of the driving transistor, "≈" is used in the above equation. Since $\Delta V = \Delta Q/C$ ($\Delta V$ is the compensation voltage that the first power signal voltage pvdd compensates the gate electrode G of the driving transistor DT, C is a capacitance of constant value), $\Delta V = (I_{ds} \times \Delta t)/C$. That is, a magnitude of the voltage compensation on the gate electrode G of the driving transistor DT by the first power signal voltage pvdd may be controlled through changing the duration time of the compensation stage A3 $\Delta t$ (that is the duration time of the enable signal transmitted to the pixel driving circuit through the second scan signal line SCAN2).

In one embodiment, the display panel may include two different pixels or one pixel at two different times. The two different pixels (or one pixel at two different times) in the display panel may correspond to two first power signal voltage pvdd1 and pvdd2 connected to sources of corresponding driving transistors, corresponding voltage difference between a gate electrode and a source of each driving transistor is $V_{gs1}$ and $V_{gs2}$ respectively. When data signals corresponding to the corresponding driving transistors are same, for the voltage difference between a gate electrode and a source of the corresponding driving transistors, Vgs1 may be larger than $V_{gs2}$. According to the driving current equation $I_{ds} = K*(V_{gs} - V_{th})^2$, for the driving current corresponding to the corresponding driving transistors, Ids1>Ids2. From $\Delta V = (I_{ds} \times \Delta t)/C$, after the compensation time $\Delta t$, change in the voltage of the gate electrode of the corresponding driving transistors may be $\Delta V_1 > \Delta V_2$, and correspondingly $V_{data} + \Delta V_1 > V_{data} + \Delta V_2$ for the voltage of the gate electrode of the corresponding driving transistors. According to the voltage difference between the gate electrode and the source of the driving transistor given by $V_{gs} = V_g - V_s = V_{data} + \Delta V -$ pvdd, and a difference between the voltage difference of the gate electrode and the source of different driving transistors corresponding to two different pixels (or one pixel at two different times) may be reduced. In the present disclosure, for the same compensation time, a larger one of the first power signal voltage may compensate the voltage of the gate electrode of a corresponding driving transistor more, and a smaller one of the first power signal voltage may compensate the voltage of the gate electrode of a corresponding driving transistor less. Then a change in the voltage difference of the gate electrode and the source of a driving transistor corresponding to the larger first power signal voltage may be larger than a change in the voltage difference of the gate electrode and the source of a driving transistor corresponding to the smaller first power signal voltage. A difference between $V_{gs1}$ and $V_{gs2}$ may be reduced to reduce a difference between the driving current of the driving transistors corresponding to two different pixels (or one pixel at two different times). A compensation performance and a uniformity of the display may be improved.

In some embodiments illustrated in FIGS. 1-2, the first transistor T1, the second transistor T2, the third transistor T3, the fourth transistor T4, and the driving transistor DT may be N-type or P-type transistors.

In one embodiment, the first transistor T1, the second transistor T2, the third transistor T3, the fourth transistor T4, and the driving transistor DT may be P-type transistors. As illustrated in FIGS. 1-2, the first transistor T1 and the third transistor T3 connected to the first scan signal line SCAN1, the second transistor T2 connected to the second scan signal line SCAN2, and the fourth transistor T4 connected to the light-emitting signal line EMIT, are all P-type transistors. A P-type transistor may be turned on by a low voltage signal and may be turned off by a high voltage signal. An N-type transistor may be turned off by a low voltage signal and may be turned on by a high voltage signal. In FIG. 1, when the light-emitting signal line EMIT, the first scan signal line SCAN1, and the second scan signal line SCAN2 provide electrical signals with low voltage, the first transistor T1, the second transistor T2, the third transistor T3, and the fourth transistor T4 may be turned on. Otherwise, the first transistor T1, the second transistor T2, the third transistor T3, the fourth transistor T4 may be turned off. As illustrated in FIG. 2, when the first transistor T1, the second transistor T2, the third transistor T3, the fourth transistor T4, and the driving transistor DT may be P-type transistors, effective signals of the first scan signal line SCAN1, the second scan signal line SCAN2, and a control terminal of the light-emitting signal line EMIT may be low voltage signals, and ineffective signals may be high voltage signals. For description purposes only, the above embodiment where the first transistor T1, the second transistor T2, the third transistor T3, the fourth transistor T4, and the driving transistor DT are P-type transistors, are used as an example to illustrate the present disclosure, and should not limit the scopes of the present disclosure. In some other embodiments, the first transistor T1, the second transistor T2, the third transistor T3, the fourth transistor T4, and the driving transistor DT may be N-type transistors. Correspondingly, effective signals of the first scan signal line SCAN1, the second scan signal line SCAN2, and a control terminal of the light-emitting signal line EMIT may be high voltage signals, while ineffective signals may be low voltage signals. The timing chart in FIG. 1 corresponding to the driving method for the pixel driving circuit may be changed accordingly.

Figure 5:
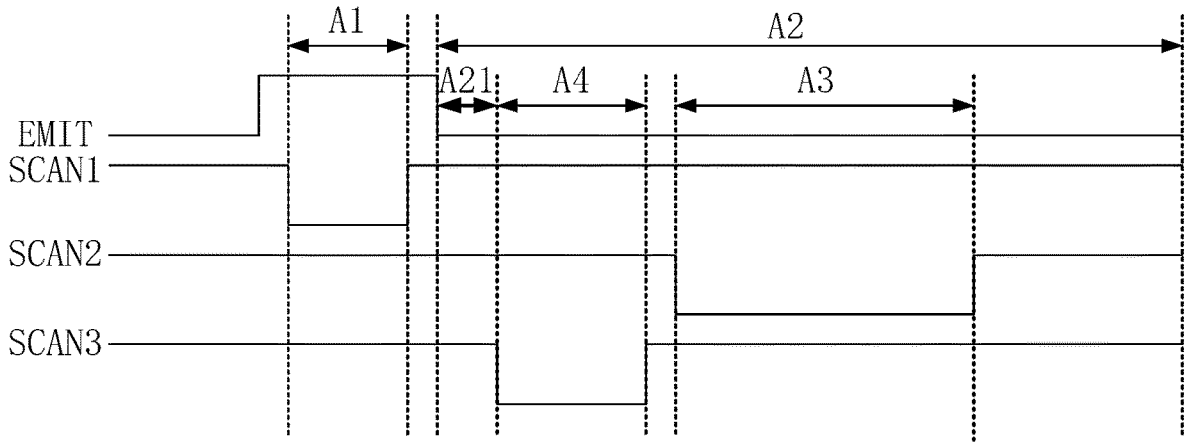
FIG. 5 illustrates a driving timing chart corresponding to another exemplary driving method for a pixel driving circuit consistent with various disclosed embodiments in the present disclosure.
Figure 6:
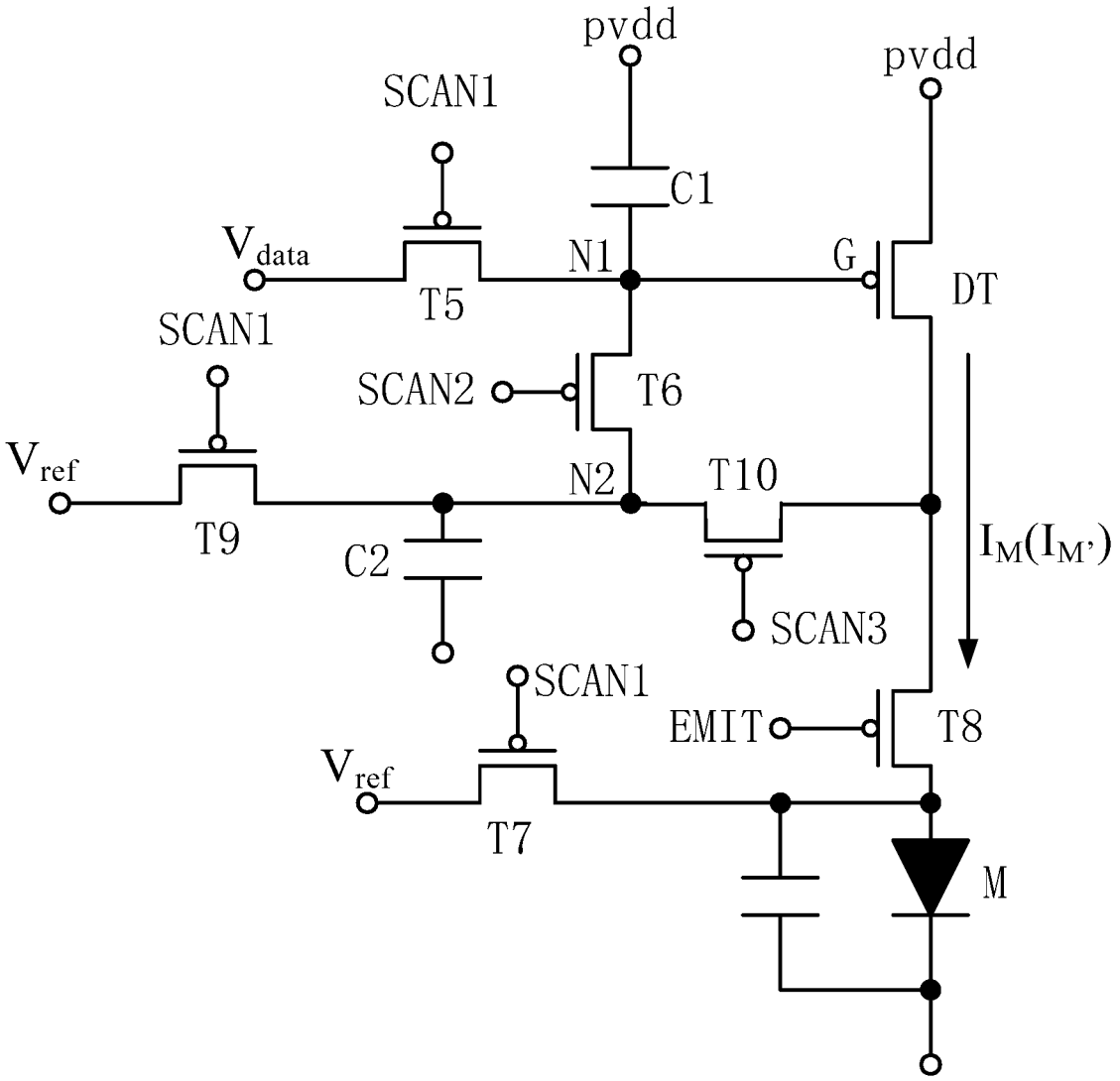
FIG. 6 illustrates another exemplary pixel driving circuit consistent with various disclosed embodiments in the present disclosure.

FIG. 5 illustrates a driving timing chart corresponding to another exemplary driving method for a pixel driving circuit consistent with various disclosed embodiments in the present disclosure, and FIG. 6 illustrates another exemplary pixel driving circuit consistent with various disclosed embodiments in the present disclosure. In one embodiment illustrated in FIGS. 5-6, the pixel driving circuit may further include a storage capacitor C2, and the driving method may further include a cache stage A4. In the cache stage A4, responding to the voltage of the gate electrode G of the driving transistor DT and scan signals on a third scan signal line SCAN3, the first power signal voltage pvdd may be transmitted to the storage capacitor C2 to store the first power signal voltage pvdd in the storage capacitor C2.

The cache stage A4 may be performed after the starting time of the light-emitting stage A2 but before the starting time of the compensation stage A3.

In the present disclosure, the driving method for the pixel driving circuit may further include the cache stage A4 performed after the starting time of the light-emitting stage A2 and before the starting time of the compensation stage A3. In the cache stage A4, responding to the voltage of the gate electrode G of the driving transistor DT and scan signals on a third scan signal line SCAN3 (the voltage of the gate electrode G of the driving transistor DT may an enable signal to the driving transistor DT and the third scan signal line SCAN3 may transmit enable signals to the pixel driving circuit, while other wires including the first scan signal line SCAN1 and the second scan signal line SCAN2 may transmit non-enable signals to the pixel driving circuit), the first power signal voltage pvdd may be transmitted to the storage capacitor C2 to store the first power signal voltage pvdd in the storage capacitor C2. Therefore, an opening of the compensation stage A4 may be flexibly controlled. When the compensation is required according to actual needs, the first power signal voltage pvdd stored in the storage capacitor C2 may be transmitted to the gate electrode G of the driving transistor DT for voltage compensation based on the actual conditions. When the compensation is not required according to actual needs, the first power signal voltage pvdd may be kept stored in the storage capacitor C2 and then may be used for compensation when the compensation becomes necessary. The timing of the compensation may be controlled flexibly, and the compensation effect may be improved simultaneously. Correspondingly, whether the compensation is performed or not may be selected according to the actual conditions. The unevenness of the display may be reduced further and the display quality may be improved.

For description purposes only, the embodiment with the time chart illustrated in FIG. 5 further including the cache stage A4 is used as an example to illustrate the present disclosure and should not limit scopes of the present disclosure. In various embodiments, the time chart corresponding to the driving method for the pixel driving circuit may include any suitable working stages, as long as the light-emitting stage A2 and the compensation stage A3 overlap, the starting time of the compensation stage A3 is after the starting time of the light-emitting stage A2, the cache stage A4 is performed after the starting time of the light-emitting stage A2 and before the starting time of the compensation stage A3, and the timing of the compensation may be controlled flexibly to reduce the unevenness of the display.

In some embodiments illustrated in FIGS. 5-6, the pixel driving circuit may further include a fifth transistor T5, a sixth transistor T6, a seventh transistor T7, and an eighth transistor T8, a ninth transistor T9, and a tenth transistor T10.

For the fifth transistor T5, a gate electrode may be electrically connected t the first scan signal line SCAN1, a first electrode may be electrically connected to the data signal line, and a second electrode may be electrically connected to the first node N1. The data signal line may provide the data signal voltage \Tama.

For the driving transistor DT, the gate electrode may be electrically connected to the first node N1, the first electrode may be electrically connected to first power signal line, and the second electrode may be electrically connected to a first electrode of the eighth transistor T8. The first power signal line may provide the first power signal voltage pvdd.

For the sixth transistor T6, a gate electrode may be electrically connected to the second scan signal line SCAN2, a first electrode may be electrically connected to the first node N1, and a second electrode may be electrically connected to a second node N2.

For the seventh transistor T7, a gate electrode may be electrically connected to the first scan signal line SCAN1, a first electrode may be electrically connected to the reference voltage signal line, and a second electrode may be electrically connected to a second electrode of the eighth transistor T8. The reference voltage signal line may provide the reference signal voltage $V_{ref}$.

For the eighth transistor T8, a gate electrode may be electrically connected to the light-emitting signal line EMIT, and the second electrode may be electrically connected to the light-emitting device M.

For the ninth transistor T9, a gate electrode may be electrically connected to the first scan signal line SCAN1, a first electrode may be electrically connected to the reference voltage signal line, and a second electrode may be electrically connected to the second node N2.

For the tenth transistor T10, a gate electrode may be electrically connected to a third scan signal line SCANS, a first electrode may be electrically connected to the second node N2, and a second electrode may be electrically connected to the second electrode of the driving transistor DT.

For the storage capacitor C2, a first electrode may be electrically connected to the second node N2, and a second electrode may be electrically connected to the first power signal line.

The pixel driving circuit corresponding to the driving method in the embodiment of the present disclosure may work in following processes:

in the data writing stage A1, the fifth transistor T5, the seventh transistor T7, and the ninth transistor T9 may be turned on, the sixth transistor T6, the eighth transistor T8, and the tenth transistor T10 may be turned off, correspondingly the data signal line may transmit the data signal voltage $V_{data}$ to the first node N1 and the gate electrode G of the driving transistor DT, and the reference voltage signal line may transmit the reference signal voltage $V_{ref}$ to the second node N2 and the light-emitting device M;

in a starting stage (A21 in FIG. 5) of the light-emitting stage A2, the eighth transistor T8 may be turned on, while the fifth transistor T5, the sixth transistor T6, the seventh transistor T7, the ninth transistor T9, and the tenth transistor T10 may be turned off, the driving path between the driving transistor DT and the light-emitting device M may be conductive and the driving transistor DT may generate the driving current IM according to the voltage of the gate electrode of the driving transistor DT to drive the light-emitting device M to emit light;

in the cache stage A4, the eighth transistor T8 and the tenth transistor T10 may be turned on, while the fifth transistor T5, the sixth transistor T6, the seventh transistor T7, and the ninth transistor T9 may be turned off, correspondingly, the first power signal voltage pvdd may be transmitted to the second node N2 and an electrode of the storage capacitor C2, to store the first power signal voltage pvdd in the storage capacitor C2;

in the compensation stage A3, the sixth transistor T6 and the eighth transistor T8 may be turned on, while the fifth transistor T5, the seventh transistor T7, the ninth transistor T9, and the tenth transistor T10 may be turned off, correspondingly, a portion of the first power signal voltage pvdd may be transmitted to the gate electrode G of the driving transistor DT through the second node N2, a wire connecting the input terminal of the first power signal voltage pvdd and the first node N1 may be conductive to charge or discharge the first capacitor C1 (whether the first capacitor is charged or discharged can be configured based on a comparison between the voltage of the first node N1 and the voltage of the second electrode of the driving transistor DT), then the voltage of the gate electrode G of the driving transistor may be compensated; and at last, the eighth transistor T8 may be turned on, while the fifth transistor T5, the sixth transistor T6, the seventh transistor T7, the ninth transistor T9, and the tenth transistor T10 may be turned off, correspondingly the driving transistor DT may generate the new driving current $I_M'$ according to the voltage after compensation of the gate electrode G of the driving transistor DT to drive the light-emitting device M to emit light.

In the present disclosure, the signals of the first scan signal line SCAN1, the second scan signal line SCAN2, the third scan signal line SCAN3, the light-emitting signal line EMIT, the data signal line, the first power signal line, and the reference voltage signal line, may be provided by a driving chip in the display panel or by other external configuration. The present disclosure has no limit on this. For description purposes only, the embodiment with the above circuit structure for the pixel driving circuit corresponding to the driving method above are used as examples to illustrate the present disclosure and should not limit the scopes of the present disclosure. In various embodiments, the pixel driving circuit may have any suitable circuit structure and the present disclosure has no limit on this. For one of the transistors in the pixel driving circuit, the first electrode may be the source of the transistor and the second electrode may be the drain of the transistor, or the first electrode may be the drain of the transistor and the second electrode may be the source of the transistor. The present disclosure has no limit on this.

In some embodiments, the fifth transistor T5, the sixth transistor T6, the seventh transistor T7, the eighth transistor T8, the ninth transistor T9, the tenth transistor T10, and the driving transistor DT may be N-type or P-type transistors.

In one embodiment illustrated in FIGS. 5-6, the fifth transistor T5, the sixth transistor T6, the seventh transistor T7, the eighth transistor T8, the ninth transistor T9, the tenth transistor T10, and the driving transistor DT may be P-type transistors. As illustrated in FIGS. 5-6, the fifth transistor T5, the seventh transistor T7, and the ninth transistor T9 connected to the first scan signal line SCAN1, the sixth transistor T6 connected to the second scan signal line SCAN2, the tenth transistor T10 connected to the third scan signal line SCAN3, and the eighth transistor T8 connected to the light-emitting signal line EMIT, are all P-type transistors. A P-type transistor may be turned on by a low voltage signal and may be turned off by a high voltage signal. An N-type transistor may be turned off by a low voltage signal and may be turned on by a high voltage signal. In FIG. 5, when the light-emitting signal line EMIT, the first scan signal line SCAN1, the second scan signal line SCAN2, and the third scan signal line SCAN3 provide electrical signals with low voltage, the fifth transistor T5, the sixth transistor T6, the seventh transistor T7, the eighth transistor T8, the ninth transistor T9, and the tenth transistor T10 may be turn on. Otherwise, the fifth transistor T5, the sixth transistor T6, the seventh transistor T7, the eighth transistor T8, the ninth transistor T9, and the tenth transistor T10 may be turned off. For description purposes only, the above embodiment where the fifth transistor T5, the sixth transistor T6, the seventh transistor T7, the eighth transistor T8, the ninth transistor T9, the tenth transistor T10, and the driving transistor DT are P-type transistors, is used as an example to illustrate the present disclosure, and should not limit the scopes of the present disclosure. In some other embodiments, the fifth transistor T5, the sixth transistor T6, the seventh transistor T7, the eighth transistor T8, the ninth transistor T9, the tenth transistor T10, and the driving transistor DT may be N-type transistors. The timing chart in FIG. 5 corresponding to the driving method for the pixel driving circuit may be changed accordingly.

In some embodiments, the transistors may be field-effect transistors (FETs). In some other embodiments, the transistors may be other type transistors. The present disclosure has no limit on this. In various embodiments, any suitable devices may be used to achieve above circuit as long as the devices can achieve switching functions.

In some embodiments illustrated in FIGS. 1-6, the light-emitting device M may be a sub-millimeter light-emitting diode.

The light-emitting device M may be a sub-millimeter light-emitting diode, that is the so-called Mini LED with a size smaller than 500 μm. Using the sub-millimeter light-emitting diode as the light-emitting device M in the pixel driving circuit, the pixel may have advantages including high color saturation, local dimming, high brightness, energy saving. Since the sub-millimeter light-emitting diode is used as the light-emitting device M in the pixel driving circuit, the driving current in the driving transistor DT may need to be on an order of several tens of milliamperes. In comparison with a driving current of a driving transistor for driving an organic light-emitting diode, the driving current for the sub-millimeter light-emitting diode may be hundreds of thousands of times that of the organic light-emitting diode. In the present disclosure, when using the sub-millimeter light-emitting diode as the light-emitting device M in the pixel driving circuit, different first power signal voltages pvdd corresponding to different pixels may be inconsistent, and the driving method in the present disclosure may be necessary for driving the pixel driving circuit provided by the present disclosure. Correspondingly, a time for the second scan signal line SCAN2 to transmit enable signals to the pixel driving circuit (that is, the compensation time) may be configured based on a voltage drop of the first power signal voltage pvdd, the data signal voltage $V_{data}$, and the compensation may start when the light-emitting stage starts. Influence of the current may be included in the compensation process to achieve better compensation. The unevenness of the display may be improved further.

Figure 7:
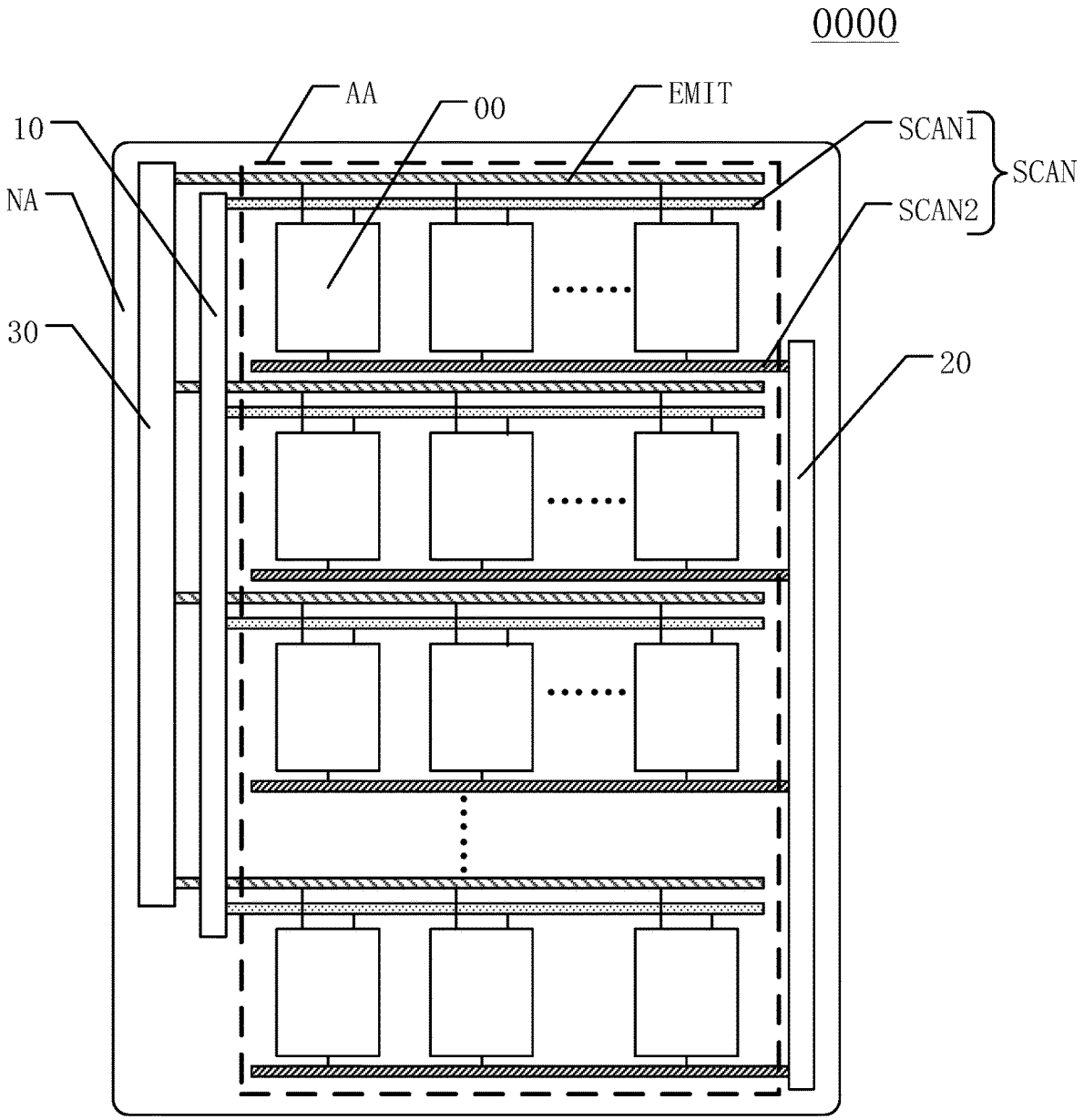
FIG. 7 illustrates an exemplary display panel consistent with various disclosed embodiments in the present disclosure.

The present disclosure also provides a display panel. As illustrated in FIG. 7, the display panel 0000 may include a display region AA and a non-display region NA.

The display region AA may include a plurality of pixel units 00 arranged in an array, a plurality of light-emitting signal lines EMIT, a plurality of scan signal lines SCAN. The plurality of pixel units 00 may include pixel driving circuits. The pixel driving circuits may be driven by a driving method provided by the present disclosure. The plurality of scan signal lines SCAN may at least include a plurality of first scan signal lines SCAN1 and a plurality of second scan signal lines SCAN2.

The pixel driving circuits, corresponding to pixel units 00 of the plurality of pixel units 00 in a same row, may be electrically connected to one (e.g., a same one) of the plurality of first scan signal lines SCAN1 and electrically connected one (e.g., a same one) of the plurality of second scan signal lines SCAN2.

The non-display region NA may include a first scan signal control circuit 10, a second scan signal control circuit 20, a light-emitting signal control circuit 30. The first scan signal control circuit 10 may be electrically connected to the plurality of first scan signal lines SCAN1 and the second scan signal control circuit 20 may be electrically connected to the plurality of second scan signal lines SCAN2. The light-emitting signal control circuit 30 may be electrically connected to the plurality of light-emitting signal lines EMIT.

In the present disclosure, the plurality of first scan signal lines SCAN1, the plurality of second scan signal lines SCAN2, and the plurality of light-emitting signal lines EMIT may be electrically connected to corresponding control circuits in the non-display region of the display panel, to get control signals for controlling the pixel driving circuits 01 in the display region AA of the display panel 0000 and making the plurality of pixel units 00 emit light for display. The plurality of first scan signal lines SCAN1 may get control signals from the first scan signal control circuit 10, the plurality of second scan signal lines SCAN2 may get control signals from the second scan signal control circuit 20, and the plurality of light-emitting signal lines EMIT may get control signals from the light-emitting signal control circuit 30. The pixel driving circuits corresponding to pixel units 00 of the plurality of pixel units 00 in a same row may be electrically connected to one of the plurality of first scan signal lines SCAN1 and one of the plurality of second scan signal lines SCAN2. That is, each of the plurality of first scan signal lines SCAN1 and corresponding one of the plurality of second scan signal lines SCAN2 may provide electrical signals to pixel units 00 of the plurality of pixel units 00 in a same row.

For description purposes only, the embodiment illustrated in FIG. 7 showing only a portion of the structure of the display panel 0000 is used as an example to illustrate the present disclosure, and should not limit the scopes of the present disclosure. In various embodiments, the display panel 0000 may have any suitable structure. Also, the embodiment in FIG. 7 with a position relationship and a connecting relationship between the first scan signal control circuit 10, the second scan signal control circuit 20 and the light-emitting signal control circuit 30 is used as an example to illustrate the present disclosure, and should not limit the scopes of the present disclosure. In various embodiments, the first scan signal control circuit 10, the second scan signal control circuit 20 and the light-emitting signal control circuit 30 may be disposed in the non-display region NA in any suitable configuration.

Figure 8:
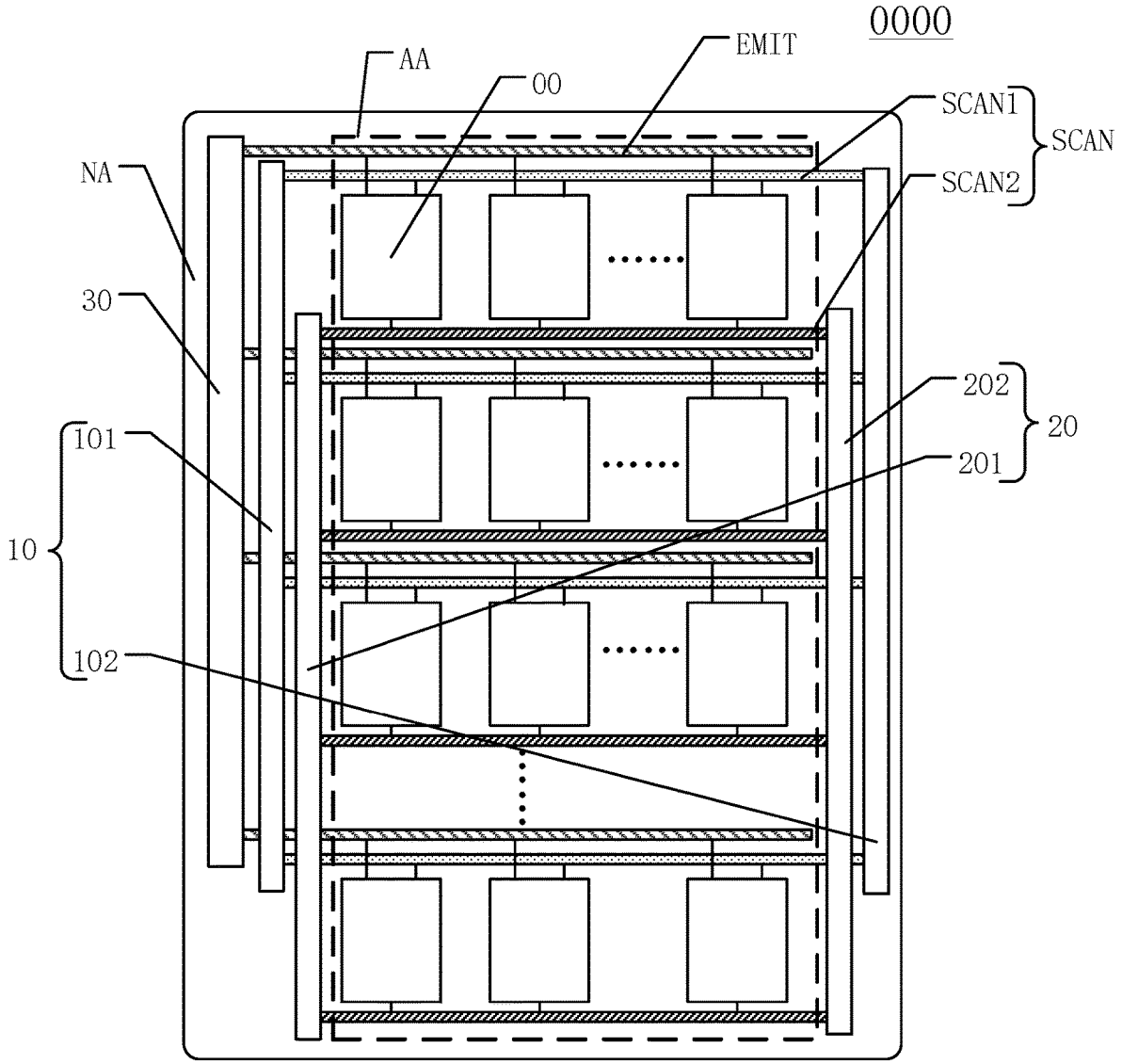
FIG. 8 illustrates another exemplary display panel consistent with various disclosed embodiments in the present disclosure.

In another embodiment of the present disclosure illustrated in FIG. 8, in the display panel 0000, the first scan signal control circuit 10 may include a first sub scan signal control circuit 101 and a second sub scan signal control circuit 102. The first sub scan signal control circuit 101 and the second sub scan signal control circuit 102 may be disposed at two opposite sides of the display panel 0000. The second scan signal control circuit 10 may include a third sub scan signal control circuit 201 and a fourth sub scan signal control circuit 202. The third sub scan signal control circuit 201 and the fourth sub scan signal control circuit 202 may be disposed at two opposite sides of the display panel 0000.

For each of the plurality of first scan signal lines SCAN1, an end may be electrically connected to the first sub scan signal control circuit 101, and another end may be electrically connected to the second sub scan signal control circuit 102.

For each of the plurality of second scan signal lines SCAN2, an end may be electrically connected to the third sub scan signal control circuit 201, and another end may be electrically connected to the fourth sub scan signal control circuit 202.

In the present disclosure, two ends of each of the plurality of first scan signal lines SCAN1 may be electrically connected to the first sub scan signal control circuit 101 and the second sub scan signal control circuit 102 respectively, and two ends of each of the plurality of second scan signal lines SCAN2 may be electrically connected to the third sub scan signal control circuit 201 and the fourth sub scan signal control circuit 202 respectively. Correspondingly, the first sub scan signal control circuit 101 and the second sub scan signal control circuit 102 may provide the scan signals to one of the plurality of first scan signal lines SCAN1 from two sides of the display panel simultaneously, while the third sub scan signal control circuit 201 and the fourth sub scan signal control circuit 202 may provide the scan signals to one of the plurality of second scan signal lines SCAN2 from two sides of the display panel simultaneously. For pixel units of the plurality of pixel units in a same row, the driving signals may be provided from both ends to a middle simultaneously by using a bilateral driving method. A driving time for the plurality of pixel units 00 may be reduced and efficiency may be improved.

In one embodiment, the plurality of pixel units of the display panel 0000 may include pixel units with three different colors including red pixel units, blue pixel units, and green pixel units. In other embodiments, the plurality of pixel units of the display panel 0000 may include pixel units with four different colors including red pixel units, blue pixel units, green pixel units, and white pixel units.

In some embodiments, the pixel units with different colors may have different areas.

Figure 9:
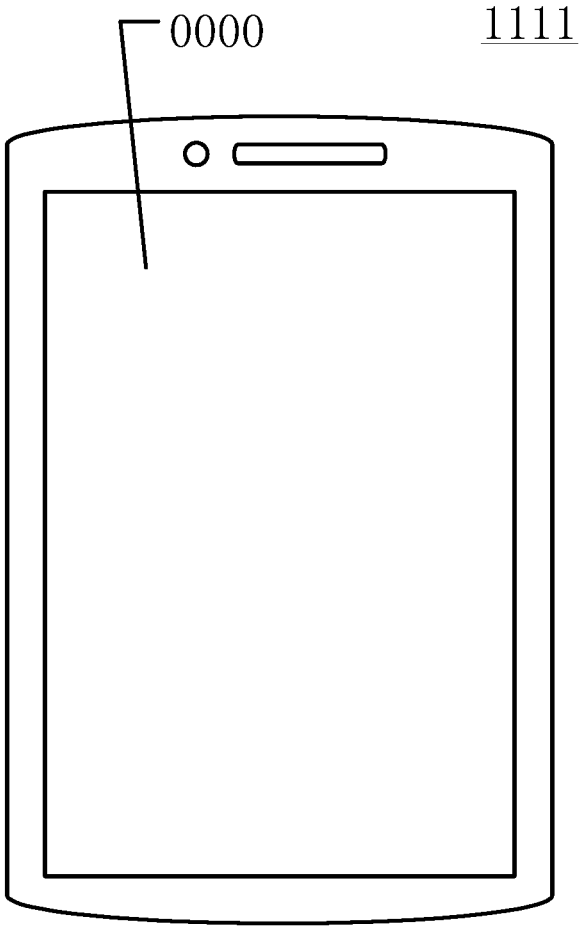
FIG. 9 illustrates an exemplary display device consistent with various disclosed embodiments in the present disclosure.

The present disclosure also provides a display device. As illustrated in FIG. 9, in one embodiment, the display device 1111 may include a display panel 0000 provided by various embodiments of the present disclosure. For description purposes only, the embodiment illustrated in FIG. 9 where the display device 1111 is a cell phone is used as an example to illustrate the present disclosure and should not limit the scopes of the present disclosure. In various embodiments, the display device 111 may be a computer, a vehicle display device, or another display device with a display function. The present disclosure has no limit on this. The display device 1111 may have advantages of the display panel 0000 provided by various embodiments of the present disclosure, and may have advantages of a driving method provided by various embodiments of the present disclosure since the plurality of pixel units 00 in the display panel 0000 may be driven by a driving method provided by various embodiments of the present disclosure, which can be referred to the previous illustration.

In the present disclosure, the driving method may include at least the data writing stage, the light-emitting stage, and the compensation stage. In the data writing stage, the data signal voltage may be transmitted to the gate electrode of the driving transistor. In the light-emitting stage, the driving path between the driving transistor and the light-emitting device may be turned on, and the driving transistor may generate the driving current according to the voltage at the gate electrode of the driving transistor to drive the light-emitting device to emit light. After starting the light-emitting stage, the compensation stage may start. The voltage of the gate electrode of the driving transistor may be compensated using the first power signal voltage. Then the driving transistor may generate the new driving current according to the voltage after compensation of the gate electrode of the driving transistor to drive the light-emitting device to emit light. The light-emitting stage and the compensation stage may overlap, and the starting time of the compensation stage may be after the starting time of the light-emitting stage. The influence of the current of the present pixel may be considered in the compensation, and the compensation may be performed simultaneously when emitting light. The first power signal line may provide the first power signal voltage to the pixel driving circuit, and different driving currents may induce different voltage drop of the first power signal line. Correspondingly, the first power signal voltage corresponding to the pixel may change with different driving currents and the display uniformity may be affected. In the compensation stage, the voltage of the gate electrode of the driving transistor may be compensated using the first power signal voltage. Since the starting time of the compensation stage may be after the starting time of the light-emitting stage, influence of different driving currents on the first power signal voltage may be compensated in real-time. A difference between the driving current in different pixel driving circuits corresponding to different pixels may be reduced, and a display of different pixels may be more uniform. A better display quality may be achieved, and display performance of the display panel may be improved.

Various embodiments have been described to illustrate the operation principles and exemplary implementations. It should be understood by those skilled in the art that the present disclosure is not limited to the specific embodiments described herein and that various other obvious changes, rearrangements, and substitutions will occur to those skilled in the art without departing from the scope of the disclosure. Thus, while the present disclosure has been described in detail with reference to the above described embodiments, the present disclosure is not limited to the above described embodiments but may be embodied in other equivalent forms without departing from the scope of the present disclosure, which is determined by the appended claims.

What is claimed is:

1. A driving method for a pixel driving circuit including a driving transistor and a light-emitting device, comprising:

in a data writing stage, transmitting a data signal voltage to a gate electrode of the driving transistor in response to a scan signal in a first scan signal line;

in a light-emitting stage, in response to a light-emitting signal in a light-emitting signal line, turning on a driving path between the driving transistor and the light-emitting device, and making the driving transistor generate a driving current based on a voltage of the gate electrode of the driving transistor to drive the light-emitting device to emit light; and in a compensation stage, in response to the light-emitting signal in the light-emitting signal line and a scan signal in a second scan signal line, using a first power signal voltage to compensate the voltage of the gate electrode of the driving transistor, wherein:

the light-emitting stage and the compensation stage overlap with each other, and a starting time of the compensation stage is after a starting time of the light-emitting stage, the pixel driving circuit further includes a first transistor, a second transistor, a third transistor, and a fourth transistor;

for the first transistor, a gate electrode is electrically connected to the first scan signal line, a first electrode is electrically connected to a data signal line, and a second electrode is electrically connected to a first node, wherein the data signal line provides the data signal voltage;

for the driving transistor, the gate electrode is electrically connected to the first node, a first electrode is electrically connected to the first power signal line, and a second electrode is electrically connected to a first electrode of the fourth transistor, wherein the first power signal line provides the first power signal voltage;

for the second transistor, a gate electrode is electrically connected to the second scan signal line, a first electrode is electrically connected to the first node, and a second electrode is electrically connected to the second electrode of the driving transistor;

for the third transistor, a gate electrode is electrically connected to the first scan signal line, a first electrode is electrically connected to a reference voltage signal line, and a second electrode is electrically connected to a second electrode of the fourth transistor, wherein the reference voltage signal line provides a reference signal voltage; and for the fourth transistor, a gate electrode is electrically connected to the light-emitting signal line, and the second electrode is electrically connected to the light-emitting device.

2. The method according to claim 1, wherein:

the first transistor, the second transistor, the third transistor, the fourth transistor, and the driving transistor are N-type transistors or P-type transistors.

3. The method according to claim 1, wherein:

the light-emitting device is a sub-millimeter light-emitting diode.

4. A driving method for a pixel driving circuit including a driving transistor and a light-emitting device, comprising:

in a data writing stage, transmitting a data signal voltage to a gate electrode of the driving transistor in response to a scan signal in a first scan signal line;

in a light-emitting stage, in response to a light-emitting signal in a light-emitting signal line, turning on a driving path between the driving transistor and the light-emitting device, and making the driving transistor generate a driving current based on a voltage of the gate electrode of the driving transistor to drive the light-emitting device to emit light; and in a compensation stage, in response to the light-emitting signal in the light-emitting signal line and a scan signal in a second scan signal line, using a first power signal voltage to compensate the voltage of the gate electrode of the driving transistor, wherein:

the light-emitting stage and the compensation stage overlap with each other, and a starting time of the compensation stage is after a starting time of the light-emitting stage;

the pixel driving circuit further includes a storage capacitor; and the method further includes a cache stage, wherein:

in the cache stage, in response to the voltage of the gate electrode of the driving transistor and a scan signal in a third scan signal line, the first power signal voltage is transmitted to the storage capacitor to store the first power signal voltage in the storage capacitor, and the cache stage undergoes after the starting time of the light-emitting stage and before the starting time of the compensation stage.

5. The method according to claim 4, wherein:

the pixel driving circuit further includes a fifth transistor, a sixth transistor, a seventh transistor, and an eighth transistor, a ninth transistor, and a tenth transistor;

for the fifth transistor, a gate electrode is electrically connected to the first scan signal line, a first electrode is electrically connected to a data signal line, and a second electrode is electrically connected to a first node, wherein the data signal line provides the data signal voltage;

for the driving transistor, the gate electrode is electrically connected to the first node, a first electrode is electrically connected to a first power signal line, and a second electrode is electrically connected to a first electrode of the eighth transistor, wherein the first power signal line provides the first power signal voltage;

for the sixth transistor, a gate electrode is electrically connected to the second scan signal line, a first electrode is electrically connected to the first node, and a second electrode is electrically connected to a second node;

for the seventh transistor, a gate electrode is electrically connected to the first scan signal line, a first electrode is electrically connected to a reference voltage signal line, and a second electrode is electrically connected to a second electrode of the eighth transistor, wherein the reference voltage signal line provides a reference signal voltage;

for the eighth transistor, a gate electrode is electrically connected to the light-emitting signal line, and the second electrode is electrically connected to the light-emitting device;

for the ninth transistor, a gate electrode is electrically connected to the first scan signal line, a first electrode is electrically connected to the reference voltage signal line, and a second electrode is electrically connected to the second node;

for the tenth transistor, a gate electrode is electrically connected to a third scan signal line, a first electrode is electrically connected to the second node, and a second electrode is electrically connected to the second electrode of the driving transistor; and for the storage capacitor, a first electrode is electrically connected to the second node, and a second electrode is electrically connected to the first power signal line.

6. The method according to claim 5, wherein:

the fifth transistor, the sixth transistor, the seventh transistor, the eighth transistor, the ninth transistor, the tenth transistor, and the driving transistor are N-type transistors or P-type transistors.

7. A display panel, including a display region and a non-display region, wherein:

the display region includes a plurality of pixel units arranged in an array, a plurality of light-emitting signal lines, a plurality of scan signal lines;

the plurality of pixel units includes pixel driving circuits driven by a driving method according to claim 4, wherein:

each of the pixel driving circuits includes a driving transistor and a light-emitting device; and the plurality of scan signal lines at least includes a plurality of first scan signal lines and a plurality of second scan signal lines;

the pixel driving circuits corresponding to pixel units of the plurality of pixel units disposed in a same row are electrically connected to one of the plurality of first scan signal lines and corresponding one of the plurality of second scan signal lines;

the non-display region includes a first scan signal control circuit electrically connected to the plurality of first scan signal lines, a second scan signal control circuit electrically connected to the plurality of second scan signal lines, and a light-emitting control circuit electrically connected to the plurality of light-emitting signal lines.

8. The display panel according to claim 7, wherein:

the first scan signal control circuit includes a first sub scan signal control circuit and a second sub scan signal control circuit, wherein the first sub scan signal control circuit and the second sub scan signal control circuit are disposed at two opposite sides of the display panel;

the second scan signal control circuit includes a third sub scan signal control circuit and a fourth sub scan signal control circuit, wherein the third sub scan signal control circuit and the fourth sub scan signal control circuit are disposed at two opposite sides of the display panel;

for each of the plurality of first scan signal lines, an end is electrically connected to the first sub scan signal circuit, and another end is electrically connected to the second sub scan signal circuit; and for each of the plurality of second scan signal lines, an end is electrically connected to the third sub scan signal circuit, and another end is electrically connected to the fourth sub scan signal circuit.

9. A display device including the display panel according to claim 7.

10. The method according to claim 4, wherein:

the light-emitting device is a sub-millimeter light-emitting diode.

11. A display panel, including a display region and a non-display region, wherein:

the display region includes a plurality of pixel units arranged in an array, a plurality of light-emitting signal lines, a plurality of scan signal lines;

the plurality of pixel units includes pixel driving circuits driven by a driving method, wherein:

each of the pixel driving circuits includes a driving transistor and a light-emitting device; and the driving method includes:

in a data writing stage, transmitting a data signal voltage to a gate electrode of the driving transistor in response to a scan signal in a first scan signal line;

in a light-emitting stage, turning on a driving path between the driving transistor and the light-emitting device, and making the driving transistor generate a driving current based on the voltage of the gate electrode in the driving transistor to drive the light-emitting device to emit light, in response to a light-emitting signal in a light-emitting signal line; and in a compensation stage, in response to the light-emitting signal in the light-emitting signal line and a scan signal in a second scan signal line, compensating the voltage of the gate electrode in the driving transistor by using a first power signal voltage, wherein:

light-emitting stage and the compensation stage overlap with each other, and a starting time of the compensation stage is after a starting time of the light-emitting stage;

the pixel driving circuit further includes a first transistor, a second transistor, a third transistor, and a fourth transistor;

for the first transistor, a gate electrode is electrically connected to the first scan signal line, a first electrode is electrically connected to a data signal line, and a second electrode is electrically connected to a first node, wherein the data signal line provides the data signal voltage;

for the driving transistor, the gate electrode is electrically connected to the first node, a first electrode is electrically connected to the first power signal line, and a second electrode is electrically connected to a first electrode of the fourth transistor, wherein the first power signal line provides the first power signal voltage;

for the second transistor, a gate electrode is electrically connected to the second scan signal line, a first electrode is electrically connected to the first node, and a second electrode is electrically connected to the second electrode of the driving transistor;

for the third transistor, a gate electrode is electrically connected to the first scan signal line, a first electrode is electrically connected to a reference voltage signal line, and a second electrode is electrically connected to a second electrode of the fourth transistor, wherein the reference voltage signal line provides a reference signal voltage; and for the fourth transistor, a gate electrode is electrically connected to the light-emitting signal line, and the second electrode is electrically connected to the light-emitting device;

the plurality of scan signal lines at least includes a plurality of first scan signal lines and a plurality of second scan signal lines;

the pixel driving circuits corresponding to pixel units of the plurality of pixel units disposed in a same row are electrically connected to one of the plurality of first scan signal lines and corresponding one of the plurality of second scan signal lines;

the non-display region includes a first scan signal control circuit electrically connected to the plurality of first scan signal lines, a second scan signal control circuit electrically connected to the plurality of second scan signal lines, and a light-emitting control circuit electrically connected to the plurality of light-emitting signal lines.

12. The display panel according to claim 11, wherein:

the first scan signal control circuit includes a first sub scan signal control circuit and a second sub scan signal control circuit, wherein the first sub scan signal control circuit and the second sub scan signal control circuit are disposed at two opposite sides of the display panel;

the second scan signal control circuit includes a third sub scan signal control circuit and a fourth sub scan signal control circuit, wherein the third sub scan signal control circuit and the fourth sub scan signal control circuit are disposed at two opposite sides of the display panel;

for each of the plurality of first scan signal lines, an end is electrically connected to the first sub scan signal circuit, and another end is electrically connected to the second sub scan signal circuit; and for each of the plurality of second scan signal lines, an end is electrically connected to the third sub scan signal circuit, and another end is electrically connected to the fourth sub scan signal circuit.

13. A display device including the display panel according to claim 11.

14. The display panel according to claim 11, wherein:

the first transistor, the second transistor, the third transistor, the fourth transistor, and the driving transistor are N-type transistors or P-type transistors.

15. The display panel according to claim 11, wherein:

the light-emitting device is a sub-millimeter light-emitting diode.

* * * * *